United States Patent [19]

Morrison et al.

[11] Patent Number: 5,049,027

[45] Date of Patent: Sep. 17, 1991

[54] HYDRO-ELECTRIC TOOL LOCK

[75] Inventors: Jack E. Morrison, Waukegan; John J. Kurowski, Mundelein, both of Ill.

[73] Assignee: Komatsu Dresser Company, Libertyville, Ill.

[21] Appl. No.: 483,138

[22] Filed: Feb. 21, 1990

[51] Int. Cl.[5] ..... E02F 3/34

[52] U.S. Cl. ..... 414/723; 172/273; 172/316

[58] Field of Search ..... 414/723; 172/272, 273, 172/315, 316; 298/1 A, 22 R, 23 M

[56] References Cited

U.S. PATENT DOCUMENTS

| | | | |
|---|---|---|---|
| 2,740,213 | 4/1956 | Barrett | 37/144 |
| 2,856,233 | 10/1958 | Boyce et al. | 298/23 M |
| 3,204,793 | 9/1965 | Lane | 214/140 |
| 3,272,264 | 9/1966 | Antolini | 172/273 |
| 3,705,656 | 12/1972 | Hunger et al. | 214/145 |
| 3,773,074 | 11/1973 | Miceli | 172/812 |
| 3,907,142 | 9/1975 | Welch | 214/763 |
| 4,279,084 | 7/1981 | Low et al. | 37/42 R |
| 4,586,867 | 5/1986 | Stafford | 414/723 |

*Primary Examiner*—Robert J. Spar
*Assistant Examiner*—Donald W. Underwood
*Attorney, Agent, or Firm*—Richards, Medlock & Andrews

[57] ABSTRACT

An industrial vehicle has a tool adaptor mounted on the outer ends of a pair of support arms. A self contained hydro-electric unit is mounted on the tool adaptor or on a support arm closely adjacent to the tool adaptor. The unit comprises a hydraulic reservoir, a hydraulic pump, and an electric motor which drives the pump to pass hydraulic fluid under pressure to one or more double acting hydraulic control cylinders to move an associated locking pin from a retracted position to a locking position wherein it engages a frame element of a tool to lock the tool in place in the tool adaptor.

20 Claims, 2 Drawing Sheets

FIG. 4
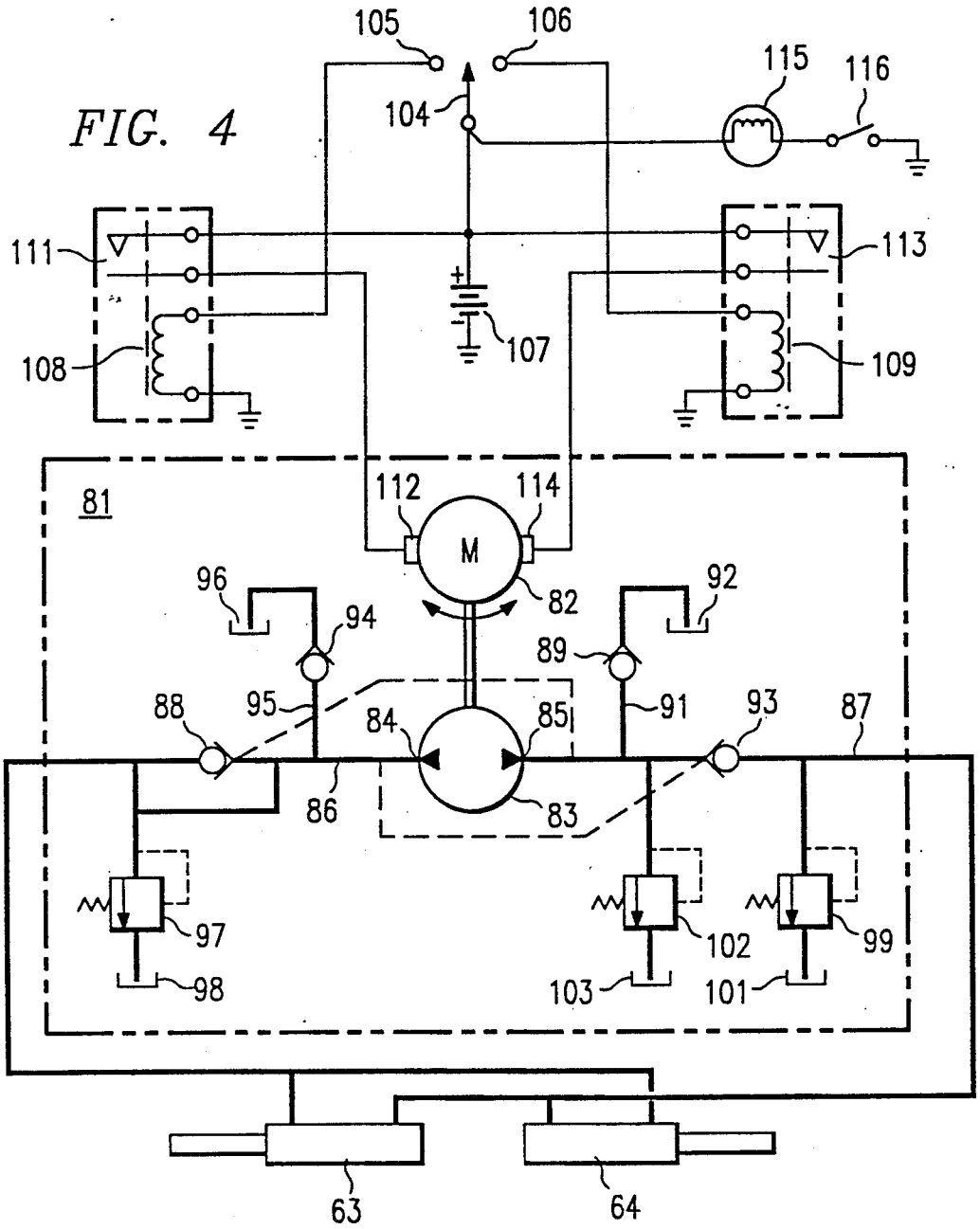
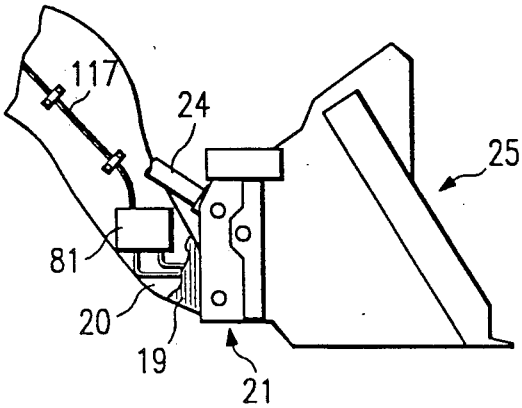
FIG. 5

HYDRO-ELECTRIC TOOL LOCK

FIELD OF THE INVENTION

This invention relates to apparatus for attaching and locking a tool to a tool adaptor positioned on the outer end of at least one lift arm supported by a vehicle. In one aspect the invention relates to a tool adaptor mounted on a vehicle, and a self contained hydro-electric unit which can be mounted on or closely adjacent to the tool adaptor for the purpose of actuating the locking pins which secure a tool to the tool adaptor.

BACKGROUND OF THE INVENTION

A multiple purpose industrial tractor having at least one vertically adjustable support arm can be provided with a tool adaptor on the outer end of the arm to permit the rapid attachment or detachment of a tool, e.g. a loader bucket assembly. In many models, the tool is attached to the tool adaptor by an element on the top of the tool mating with an element on the top of the adaptor and by one or more hydraulically actuated locking pins extending into engagement with corresponding openings in the frame elements on the tool.

The hydraulically actuated cylinders can be either continuously connected by suitable hydraulic conduits to a hydraulic system on the vehicle chassis or they can be provided with quick disconnect fittings which permit their connection to a hydraulic fluid supply system for the short periods of time necessary to accomplish assembly or disassembly. In the continuous connection embodiment, the hydraulic conduits to the locking cylinders are subject to the risk of being damaged during operation of the equipment, and the loss of fluid in the locking cylinders can result in the tool becoming unlatched from the tool adaptor. Similarly inadvertent giggling of a single operating multi-function lever by the operator could cause the locking pins to be moved to their unlocked position in the situation where the locking pin cylinders are continuously connected to the vehicle hydraulic system.

The use of quick disconnect fittings adjacent to the locking cylinders and the removal of the hydraulic supply conduits from those fittings except when needed can eliminate the damage risk associated with long supply conduits extending to the locking cylinders during the operation of the tractor. However, the use of the quick disconnect fittings also have attendant problems. For tools which have hydraulically operated elements, it is common to position the tool on the tool adaptor, connect the hydraulic fluid supply conduits to the quick disconnect fittings for the locking pin cylinders to move the locking pins into locking engagement with the tool, disconnect the hydraulic fluid supply conduits from the quick disconnect fittings for the locking pin cylinders and then connect the hydraulic fluid supply conduits to the quick disconnect fittings for the hydraulically operated elements on the tool. During disassembly of such tools from the tool adaptor, the reverse procedure is necessary. Such use of quick disconnect fittings involves multiple steps and also the risks of disruptions to the hydraulic circuits.

In both the continuous connection embodiment and the quick disconnect fitting embodiment, the inclusion of locking cylinders in the primary hydraulic circuits for the vehicle can cause problems in providing adequate capacity for all of the hydraulically actuated elements and in preventing surging in one element from interfering with the operation of another element. In addition, the vehicle must be in an active operational state in order to have the hydraulic fluid pressure available to operate the locking pin cylinders.

SUMMARY OF THE INVENTION

Accordingly, it is an object of the present invention to provide an improved means for attaching and locking a tool to a tool adaptor. Another object of the invention is to minimize the risks of damage to the hydraulic circuit for the operation of the locking pins which secure a tool to a tool adaptor on a tractor type vehicle. Another invention is to minimize the number of hydraulic connections which have to be made in the assembly or disassembly of a hydraulically actuated tool and a tool adaptor. A further object of the invention is to simplify the connection of a hydraulically actuated locking pin system to the control elements in the operator's cab. Yet another object of the invention is to simplify the design and operation of the primary hydraulic circuit on an industrial vehicle. Another object of the invention is to provide a self contained hydro-electric system on a tool adaptor for the operation of the locking pins which secure a tool to the tool adaptor. A further object of the invention is to provide means which permit the assembly or disassembly of a tool and tool adaptor on an industrial vehicle without the necessity of having to start the engine on the vehicle. Other objects, aspects, and advantages of the invention will be apparent from the following disclosure and the accompanying drawings.

In accordance with the present invention, a self contained hydro-electric unit is mounted either on the tool adaptor or on a support arm closely adjacent to the tool adaptor. The hydro-electric unit has a hydraulic reservoir, a hydraulic pump, and an electric motor which drives the hydraulic pump to pass hydraulic fluid under pressure to at least one hydraulic cylinder mounted on the tool adaptor to move a locking pin from its retracted position to its locking position or the reverse thereof. Electrical leads can connect the motor of the hydro-electric unit to an electric switch located in the operator's cab, thus simplifying the construction and operation of the tool locking system.

BRIEF DESCRIPTION OF THE DRAWINGS

FIG. 4 is a schematic diagram of the electrical and hydraulic circuits of the hydro-electric latching mechanism; and FIG. 5 is a detail view of a second embodiment of the invention wherein the hydro-electric unit is mounted on one of the support arms for the tool carrier.

DETAILED DESCRIPTION

Figures 1, 2, 3:
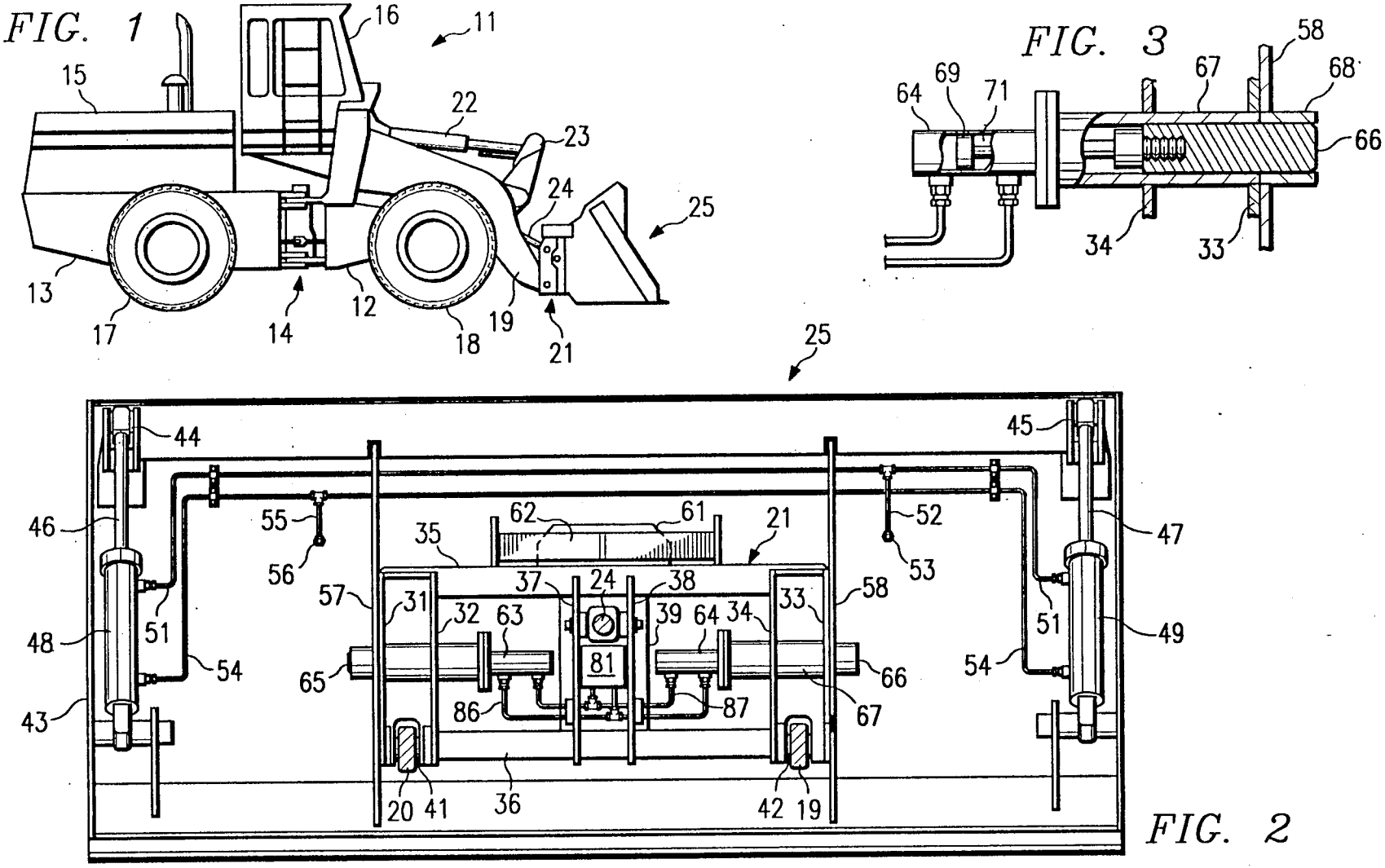
FIG. 1 is a simplified side elevational view of a rubber tired tractor vehicle having a front end tool carrier supporting a loading bucket assembly.
FIG. 2 is a rear elevational view of the tool carrier and loading bucket assembly, showing the hydroelectric latching mechanism.
FIG. 3 is a detail view, partly in cross section, of a locking pin, operated by a hydraulic cylinder, latching the loading bucket assembly to the tool carrier.

Referring now to the drawings in detail, vehicle 11 has a front chassis frame 12 and a rear chassis frame 13, which are pivotably connected together at midsection 14. A motor is provided within compartment 15, located on rear chassis frame 13, while an operator's cab 16 is supported on the front chassis frame 12 so that the operator always turns with the load and faces the work area. The vehicle 11 has two rubber tired rear wheels 17 and two rubber tired front wheels 18. Each of parallel support arms 19 and 20 has a front end secured to tool carrier 21 and a rear end pivotably secured to the front chassis frame 12. The front end of support arms 19 and 20 and tool carrier 21 can be raised and lowered by the action of hydraulic cylinder acting on and joined to support arms 19 and 20. A hydraulically actuated lever arm 24 can be secured to an upper portion of tool carrier 21 to provide for the tilting of tool carrier 21 with respect to the support arms 19 and 20. A bucket assembly 25 is connected to tool carrier 21.

Referring now to FIG. 2, the tool carrier or tool adaptor 21 comprises a rectangular frame made up of a left side outer vertical bracket member 31; a left side inner vertical bracket member 32; a right side outer vertical bracket member 33; a right side inner vertical bracket member 34; an upper horizontal bracket member 35 which is joined to the top ends of vertical bracket members 31, 32, 33, and 34; a lower horizontal bracket member 36 which is joined to the bottom ends of inner vertical bracket members 32 and 34; a pair of central vertical bracket members 37 and 38 joined at their upper ends to top horizontal bracket member 35 and joined at their lower ends to bottom horizontal bracket member 36; and a mounting plate 39 extending horizontally between and connected to vertical bracket members 37 and 38 and extending vertically between and connected to horizontal bracket members 35 and 36. A pivot pin 41 provides for the pivotable connection of support arm 20 between the lower ends of vertical bracket members 31 and 32, while pivot pin 42 provides for a similar connection of support arm 19 between the lower ends of vertical bracket members 33 and 34. The front end of lever arm 24 is pivotably secured between upper portions of central vertical bracket members 37 and 38.

The loading bucket assembly 25 has a stationary back frame 43 and a movable clam element (not shown) on the front side which is actuated by the front end of lever arms 44 and 45. The rear ends of lever arms 44 and 45 are pivotably connected to the piston arms 46 and 47, respectively, of hydraulic cylinders 48 and 49. The lower ends of hydraulic cylinders 48 and 49 are pivotably connected to bucket frame 43. The upper chamber of each of hydraulic cylinders 48 and 49 is connected through hydraulic conduits 51 and 52 to a quick disconnect hydraulic coupling 53. Similarly the lower chamber of each of hydraulic cylinders 48 and 49 is connected through hydraulic conduits 54 and 55 to a quick disconnect hydraulic coupling 56. Hydraulic hoses, not shown, provide hydraulic fluid communication between couplings 53 and 56 and a hydraulic power circuit, located on the chassis of vehicle 11, which includes a hydraulic control valve in operator cab 16. Bucket frame 43 has two vertically extending flanges 57 and 58 on the rear side thereof, which are parallel to each other and spaced from each other a distance which is only slightly greater than the horizontal width of tool adaptor 21 so that tool adaptor 21 can be mated with bucket assembly 25 by positioning tool adaptor 21 between flanges 57 and 58.

Tool adaptor 21 has a retention element 61 secured to the top side of upper bracket member 35, while the frame 43 of loading bucket assembly 25 has a retention element 62 secured to the back side thereof which mates with retention element 61. Retention element 61 can be in the form of a bar bent in the shape of a horizontal V with the apex being directed toward the rear of the tool adaptor 21, with retention element 62 also being in the form of a slightly longer bar bent in the shape of a horizontal V with a rearwardly directed apex so that the retention element 61 is engagingly received within retention element 62 when the loading bucket assembly 25 is positioned on tool adaptor 21 with tool adaptor 21 being between vertical flanges 57 and 58.

To complete the securing of the tool 25 to the tool adaptor 21, two hydraulic cylinders 63 and 64 are positioned on tool adaptor 21 to move locking pins 65 and 66, respectively, into locking engagement with vertical flanges 57 and 58. Referring now to FIG. 3, a sleeve element 67 extends through coaxial openings in right side bracket members 33 and 34, while a correspondingly sized sleeve 68 extends through an opening in vertical flange 58 so as to be coaxial with sleeve 67 when tool 25 is properly positioned on tool adaptor 21. Hydraulic control cylinder 64 has a double acting piston 69 positioned therein. Piston arm 71 is connected to piston 69 and has a free end extending beyond hydraulic control cylinder 64 into the interior of sleeve 67 where it is in threaded engagement with the left end of locking pin 66. When the tool 25 is properly positioned on tool carrier 21, the confronting surfaces of vertical flange 58 and vertical bracket member 33 mate such that the opening at the right end of sleeve 67 through vertical bracket member 33 is in coaxial alignment with the opening at the left end of sleeve 68 through flange 58. Piston 69 moves locking pin 66 between a first position wherein locking pin 66 extends through the opening in vertical bracket member 33 and into the opening of sleeve 68 to thereby lock the tool 25 in place on the tool adaptor 21, and a second position wherein locking pin 66 is retracted from the opening in sleeve 68 to thereby permit the tool 25 to be removed from tool adaptor 21. The configuration and operation of hydraulic cylinder 63 and locking pins 65 are identical to that of hydraulic cylinder 64 and locking pin 66 except that hydraulic cylinder 63 is positioned at 180 degrees with respect to hydraulic cylinder 64, so that both of the locking pins 65 and 66 move outwardly, with respect to the vertical centerline of tool adaptor 21, to their locking positions and inwardly to their retracted positions.

Referring now to FIGS. 2 and 4, a hydro-electric unit 81 is mounted on plate 39 of the tool adaptor 21 and comprises a bi-directional electric motor 82 and a bi-directional hydraulic pump 83 having first and second hydraulic ports 84 and 85. A first hydraulic conduit 86 provides fluid communication between hydraulic port 84 and the left side of the double acting piston in hydraulic cylinder 63 and the right side of the double acting piston 69 in hydraulic cylinder 64. A second hydraulic conduit 87 provides fluid communication between hydraulic port 85 and the right side of the double acting piston in hydraulic cylinder 63 and the left side of the double acting piston 69 in hydraulic cylinder 64. The motor 82 drives hydraulic pump 83 in one direction to pass hydraulic fluid through hydraulic conduit 87 to hydraulic cylinders 63 and 64 to move locking pins 65 and 66 from their retracted positions to their extended or locking positions. The motor 82 drives hydraulic pump 83 in the opposite direction to pass hydraulic fluid through hydraulic conduit 86 to hydraulic cylinders 63 and 64 to move locking pins 65 and 66 from their extended positions to their retracted positions.

A pilot operated check valve 88 is positioned in conduit 86 with its orientation permitting fluid flow from pump port 84 to cylinders 63 and 64, while a pilot operated check valve 89 is orientated in hydraulic conduit 91 to permit the passage of hydraulic fluid from supply reservoir 92 to pump port 85 when fluid is being pumped through conduit 86 to cylinders 63 and 64. Pilot operated check valve 88 is opened in response to a drop in pressure in conduit 87 between port 85 and valve 93 which is indicative of pump 83 drawing fluid from supply 92. Pilot operated check valve 93 is opened in response to a drop in pressure in conduit 86 between port 84 and valve 88 which is indicative of pump 83 taking fluid from supply source 96. Check valve 93 is positioned in conduit 87 with its orientation permitting fluid flow from pump port 85 to cylinders 63 and 64, while a check valve 94 is orientated in hydraulic conduit 95 to permit the passage of hydraulic fluid from supply reservoir 96 to pump port 84 when fluid is being pumped through conduit 87 to cylinders 63 and 64. A pressure relief valve 97 is connected to conduit 86 between check valve 88 and cylinders 63 and 64 so that when pump 83 is moving hydraulic fluid through conduit 87 to cylinders 63 and 64, hydraulic fluid will flow from the opposite sides of the pistons through conduit 86 to and through pressure relief valve 97 to sump 98. Similarly, a pressure relief valve 99 is connected to conduit 87 between check valve 93 and cylinders 63 and 64 so that when pump 83 is moving hydraulic fluid through conduit 86 to cylinders 63 and 64, hydraulic fluid will flow from the opposite sides of the pistons through conduit 87 to and through pressure relief valve 99 to sump 101. A thermal relief valve 102 is connected to conduit 87 between port 85 and valve 93 and leads to sump 103.

The direction of rotation of motor 82 is determined by the operator moving the switch contactor 104 from its neutral midposition to either terminal 105 or terminal 106. Contactor 104 is connected to the positive terminal of battery 107, located on vehicle 11. Terminal 105 is connected through solenoid 108 to ground, while terminal 106 is connected through solenoid 109 to ground. The energization of solenoid 108 closes normally open switch 111 to connect terminal 112 of motor 82 to the positive terminal of battery 107. Similarly the energization of solenoid 108 closes normally open switch 113 to connect terminal 114 of motor 82 to the positive terminal of battery 107. Motor 82 will rotate clockwise when the positive voltage is applied to a first one of the terminals and will rotate counterclockwise when the positive voltage is applied to the other terminal. Switch 104-106 is located in the operator's cab 16, along with a pilot safety light 115. Light 115 is connected in series with microswitch 116 between switch contactor 104 and ground, with microswitch 116 being actuated to a closed position only when locking pin 66 is in its fully extended locking position.

Referring now to FIG. 5, a second embodiment of the invention is illustrated wherein hydro-electric unit 81 is mounted on support arm 20 rather than on tool adaptor 21. In this case flexible hydraulic conduits are provided between unit 81 and the hydraulic cylinders located on tool adaptor 21, while the electric leads 117 extend from unit 81 along support arm 18 to the operator's cab 16 and/or the chassis portion of vehicle 11. The location of the unit 81 on the tool adaptor 21 is preferred as such arrangement provides for the greatest physical protection for the hydraulic lines for the locking pins as well as permitting the shortest hydraulic lines. In the embodiment of FIG. 5, it will generally be desirable that the unit 81 be located on the inside of the support arm and as close to the tool adaptor 21 as possible taking into consideration the need to provide for the physical protection of the unit 81 and of the hydraulic lines to the locking pins.

However, in either embodiment of the invention, the provision of a self contained hydro-electric unit 81 on or immediately adjacent to the tool adaptor 21 eliminates the need for running additional hydraulic conduits back to the hydraulic supply on the vehicle chassis, thereby minimizing incidents of the locking pins being inadvertently retracted due to damage to their hydraulic supply lines. The invention also eliminates the need for additional bulky manually operated hydraulic hose disconnect fittings. For the environment including the tool adaptor 21, support arms 19 and 20, tool manipulation mechanism 22, 23, and the vehicle chassis, it is easier and far less expensive to provide the same degree of protection to electrical leads than to hydraulic lines. The provision of the self contained hydro-electric unit 81 also avoids the complications of having the locking pin hydraulic cylinders operated by the same hydraulic system as the braking system, the steering system, the tool manipulation system, and/or the vehicle drive transmission system. As the hydro-electric unit can have its own hydraulic reservoir, the self-contained hydro-electric unit provides a more compact design. It is also not parasitic with respect to vehicle reservoirs and pumps. As the hydro-electric unit 81 is operated by the vehicle electrical system including battery 107, it permits a tool to be removed from the tool adaptor 21 or mounted on the tool adaptor 21 even though the vehicle engine is off and the primary hydraulic systems have not been actuated. The utilization of an electrical switch in the operator's cab to actuate the hydro-electric tool lock permits the installation of the self contained hydro-electric tool look on tractors which are not equipped with optional three spool hydraulics. While the use of hydraulic cylinders to actuate the locking pins is not unique to the invention, a hydraulically actuated locking pin provides higher locking forces as compared to conventional electrical solenoid actuated plungers, mechanical systems or manual systems.

While the invention has been illustrated in terms of a loading bucket assembly as the tool, other tools can be employed, e.g. a utility fork, a jib boom, a bulldozer blade, a roller, and the like. Reservoirs 92 and 96 and sumps 98, 101 and 103 can be a single container of hydraulic fluid. Hydro-electric unit 81 can be a commercially available self-contained unit of the type which has been employed in the marine industry to automatically control the trim on power boats and which is illustrated in the drawings, or it can be a specially built unit. While two support arms 19 and 20 have been illustrated, a single support arm can be employed as well as more than two support arms. Similarly while two locking pins have been illustrated, any suitable number of locking pins can be employed. Other variations and modifications to the invention are possible within the scope of the foregoing description and the appended claims.

I claim:

1. In an apparatus comprising a vehicle having a chassis, a first support arm having first and second ends, said first end of said first support arm being supported by said chassis, a tool adaptor, said tool adaptor being supported on the second end of said first support arm, a first double acting hydraulic control cylinder mounted on said tool adaptor, said first hydraulic control cylinder having a first double acting piston positioned therein and a first piston arm connected to the first piston and having a free end extending outside said first hydraulic control cylinder, said tool adaptor having a first flange mounted thereon and adapted to mate with a first surface of a tool such that an opening extending through said first flange would be in alignment with a first opening in said first surface of the tool, a first locking pin connected to the free arm of said first piston arm, said first locking pin being movable by said first piston between a first position wherein said first locking pin extends through said opening in said first flange into said first opening of a tool having its first surface mated with said first flange to thereby lock the tool in place on the tool adaptor, and a second position wherein said first locking pin is retracted from the first opening of a tool having its first surface mated with said first flange to thereby permit said tool to be removed from said tool adaptor, the improvement comprising a hydro-electric unit mounted on one of said tool adaptor and said first support arm and having first and second hydraulic ports, a first hydraulic conduit providing fluid communication between said first hydraulic port and one side of said first double acting piston in said first hydraulic cylinder, a second hydraulic conduit providing fluid communication between said second hydraulic port and the other side of said first double acting piston in said first hydraulic cylinder, said hydro-electric unit having a hydraulic pump and a bi-directional electric motor which drives said hydraulic pump to pass hydraulic fluid through one of said first and second hydraulic conduits to said first hydraulic cylinder to move said first locking pin from said first position to said second position and to pass hydraulic fluid through the other of said first and second hydraulic conduits to said first hydraulic cylinder to move said first locking pin from its second position to its first position.

2. Apparatus in accordance with claim 1 further comprising a second support arm having first and second ends, said first end of said second support arm being supported by said chassis, said first and second support arms being movable with respect to said chassis, said tool adaptor being supported on the second end of said second support arm as well as the second end of said first support arm.

3. Apparatus in accordance with claim 2 further comprising a second double acting hydraulic control cylinder mounted on said tool adaptor, said second hydraulic control cylinder having a second double acting piston positioned therein and a second piston arm connected to the second piston and having a free end extending outside said second hydraulic control cylinder, said tool adaptor having a second flange mounted thereon and adapted to mate with a second surface of a tool such that an opening extending through said second flange would be in alignment with a second opening in said second surface of the tool, a second locking pin connected to the free end of said second piston arm, said second locking pin being movable by said second piston between a first position wherein said second locking pin extends through said opening in said second flange into said second opening of a tool having its second surface mated with said second flange to thereby lock the tool in place on the tool adaptor, and a second position wherein said second locking pin is retracted from the second opening of a tool having its second surface mated with said second flange to thereby permit said tool to be removed from said tool adaptor, a third hydraulic conduit providing fluid communication between said first hydraulic port and one side of said second double acting piston in said second hydraulic cylinder, a fourth hydraulic conduit providing fluid communication between said second hydraulic port and the other side of said second double acting piston in said second hydraulic cylinder, whereby said hydraulic pump can pass hydraulic fluid through one of said third and fourth hydraulic conduits to said second hydraulic cylinder to move said second locking pin from its first position to its second position and to pass hydraulic fluid through the other of said third and fourth hydraulic conduits to said second hydraulic cylinder to move said second locking pin from its second position to its first position.

4. Apparatus in accordance with claim 3 wherein said hydro-electric unit is mounted on said tool adaptor.

5. Apparatus in accordance with claim 3 wherein said hydro-electric unit is mounted on said first support arm.

6. Apparatus in accordance with claim 3 wherein said hydro-electric unit further comprises a hydraulic fluid reservoir connected to said hydraulic pump to supply hydraulic fluid to said hydraulic pump.

7. Apparatus in accordance with claim 1 wherein the hydraulic circuit of aid hydro-electric unit is isolated from any other hydraulic circuits on said vehicle.

8. Apparatus in accordance with claim 3 further comprising a first solenoid to actuate said motor to rotate in a first direction and a second solenoid to actuate said motor to rotate in the direction opposite to said first direction.

9. Apparatus in accordance with claim 8 wherein said vehicle has an operator compartment, and further comprising electrical switching means in said operator compartment for selectively actuating one of said first and second solenoids.

10. Apparatus in accordance with claim 9 wherein said switching means has a first position in which said first solenoid is actuated, a second position in which said second solenoid is actuated, and a third position in which neither said first solenoid nor said second solenoid is actuated.

11. Apparatus in accordance with claim 10 further comprising a pilot light positioned so as to be seen by an operator in said operator compartment, and a limit switch for connecting said pilot light to an electrical power source only when one of said locking pins is in its locking position.

12. Apparatus in accordance with claim 9 wherein said first and second locking pins are positioned at least substantially horizontally on said tool adaptor.

13. Apparatus in accordance with claim 12 wherein said tool adaptor has an engaging element on the top thereof which is adapted to engage a corresponding engaging element on a tool to be supported by said tool adaptor, and wherein said first and second locking pins are located in the lower half of said tool adaptor to provide three spaced points of attachment of a tool to said tool adaptor.

14. In an apparatus comprising a vehicle having a chassis, a first support arm having first and second ends, said first end of said first support arm being supported by said chassis, a tool adaptor, said tool adaptor being supported on the second end of said first support arm, a first double acting hydraulic control cylinder mounted on said tool adaptor, said first hydraulic control cylinder having a first double acting piston positioned therein and a first piston arm connected to the first piston and having a free end extending outside said first hydraulic control cylinder, said tool adaptor having a first flange mounted thereon and adapted to mate with a first surface of a tool such that an opening extending through said first flange would be in alignment with a first opening in said first surface of the tool, a first locking pin connected to the free end of said first piston arm, said first locking pin being movable by said first piston between a first position wherein said first locking pin extends through said opening in said first flange into said first opening of a tool having its first surface mated with said first flange to thereby lock the tool in place on the tool adaptor, and a second position wherein said first locking pin is retracted from the first opening of a tool having its first surface mated with said first flange to thereby permit said tool to be removed from said tool adaptor, the improvement comprising a hydro-electric unit having first and second hydraulic ports, a first hydraulic conduit providing fluid communication between said first hydraulic port and one side of said first double acting piston in said first hydraulic cylinder, a second hydraulic conduit providing fluid communication between said second hydraulic port and the other side of said first double acting piston in said first hydraulic cylinder, said hydro-electric unit having a hydraulic pump ad a bi-directional electric motor which drives said hydraulic pump to pass hydraulic fluid through one of said first and second hydraulic conduits to said first hydraulic cylinder to move said first locking pin from said first position to said second position and to pass hydraulic fluid through the other of said first and second hydraulic conduits to said first hydraulic cylinder to move said first locking pin from its second position to its first position.

15. Apparatus in accordance with claim 14 further comprising a first solenoid to actuate said motor to rotate in a first direction and a second solenoid to actuate said motor to rotate in the direction opposite to said first direction.

16. Apparatus in accordance with claim 15 wherein said vehicle has an operator compartment, and further comprising electrical switching means in said operator compartment for selectively actuating one of said first and second solenoids.

17. Apparatus in accordance with claim 16 further comprising a pilot light positioned so as to be seen by an operator in said operator compartment, and a limit switch for connecting said pilot light to an electrical power source only when said locking pin is in its locking position.

18. Apparatus in accordance with claim 14 further comprising a second support arm having first and second ends, said first end of said second support arm being supported by said chassis, said first and second support arms being movable with respect to said chassis, said tool adaptor being supported on the second end of said second support arm as well as the second end of said first support arm.

19. Apparatus in accordance with claim 18 further comprising a second double acting hydraulic control cylinder mounted on said tool adaptor, said second hydraulic control cylinder having a second double acting piston positioned therein and a second piston arm connected to the second piston and having a free end extending outside said second hydraulic control cylinder, said tool adaptor having a second flange mounted thereon and adapted to mate with a second surface of a tool such that an opening extending through said second flange would be in alignment with a second opening in said second surface of the tool, a second locking pin connected to the free end of said second piston arm, said second locking pin being movable by said second piston between a first position wherein said second locking pin extends through said opening in said second flange into said second opening of a tool having its second surface mated with said second flange to thereby lock the tool in place on the tool adaptor, and a second position wherein said second locking pin is retracted from the second opening of a tool having its second surface mated with said second flange to thereby permit said tool to be removed from said tool adaptor, a third hydraulic conduit providing fluid communication between said first hydraulic port and one side of said second double acting piston in said second hydraulic cylinder, a fourth hydraulic conduit providing fluid communication between said second hydraulic port and the other side of said second double acting piston in said second hydraulic cylinder, whereby said hydraulic pump can pass hydraulic fluid through one of said third and fourth hydraulic conduits to said second hydraulic cylinder to move said second locking pin from its first position to its second position and to pass hydraulic fluid through the other of said third and fourth hydraulic conduits to said second hydraulic cylinder to move said second locking pin from its second position to its first position.

20. Apparatus in accordance with claim 14 wherein the hydraulic circuit of said hydro-electric unit is isolated from any other hydraulic circuits on said vehicle.

* * * * *